US005929817A

United States Patent [19]

Clark

[11] Patent Number: 5,929,817

[45] Date of Patent: Jul. 27, 1999

[54] ANTENNA MOUNTS

[75] Inventor: Derek James Clark, Downham Market, United Kingdom

[73] Assignee: Maxview Limited, Norfolk, United Kingdom

[21] Appl. No.: 08/817,745

[22] PCT Filed: Oct. 24, 1995

[86] PCT No.: PCT/GB95/02507

§ 371 Date: Apr. 24, 1997

§ 102(e) Date: Apr. 24, 1997

[87] PCT Pub. No.: WO96/13075

PCT Pub. Date: May 2, 1996

[30] Foreign Application Priority Data

Mar. 7, 1993 [GB] United Kingdom ..... 9504485
Oct. 24, 1994 [GB] United Kingdom ..... 9421361

[51] Int. Cl.[6] ..... H01Q 1/32; H01Q 3/00; H01Q 1/08

[52] U.S. Cl. ..... 343/713; 343/714; 343/711; 343/765; 343/880; 343/881; 343/882; 343/760; 343/894

[58] Field of Search ..... 343/713, 714, 343/711, 765, 880, 881, 882, 760, 894

[56] References Cited

U.S. PATENT DOCUMENTS

| | | | |
|---|---|---|---|
| 2,572,430 | 10/1951 | Balton | 343/765 |
| 3,377,595 | 4/1968 | Carr et al. | 343/713 |
| 4,811,026 | 3/1989 | Bissett | 343/714 |
| 4,873,526 | 10/1989 | Katsuo | 343/713 |
| 5,337,062 | 8/1994 | Sherwood et al. | 343/711 |

FOREIGN PATENT DOCUMENTS

| | | | |
|---|---|---|---|
| 100005 | 5/1986 | Japan | H01Q 1/320 |
| 2006997 | 1/1994 | U.S.S.R. | H01Q 3/08 |

*Primary Examiner*—Robert Kim
*Assistant Examiner*—Roy M. Punnoose
*Attorney, Agent, or Firm*—Jacobson, Price, Holman & Stern, PLLC

[57] ABSTRACT

A collapsible dish antenna mount (1) for a vehicle roof, has a mast (11) received in said roof and extending into the vehicle. The dish antenna (3) is secured to said mast (11) by a mechanical linkage operable from within said vehicle such that the dish antenna (3), when raised, may be adjusted in both azimuth and elevation. When not in use, the antenna mount (1) can be folded to reduce windage.

8 Claims, 7 Drawing Sheets

ANTENNA MOUNTS

The present invention relates to an antenna mount for fitting to a roof particularly, although not exclusively, a roof of a recreational vehicle such as a caravan or boat.

Conventionally, in order to be assured of receiving an adequate signal from a communication satellite, an antenna for the purpose has been securely fitted to a rigid mount which is adjustable in both in azimuth and elevation. Where the antenna is attached to a vehicle the elevation must be adjusted to suit the latitude of the vehicle.

Disadvantageously, such a mount is of its nature bulky and adds to the height of a vehicle on which its mounted. In the case of a recreational vehicle this can limit access to tunnels, bridges, and car parks and the like, and furthermore can have a detrimental effect on the aerodynamics or windage of a vehicle resulting in reduced fuel economy and potentially dangerous handling.

Accordingly, it is an object of the present invention to provide a simplified antenna mount which overcomes the disadvantages of the prior art and which facilitates simple and rapid positioning for reception of signals.

According to the present invention there is provided a collapsible dish antenna for a vehicle roof comprising a mast slidably and rotatably received in a mount for attachment to the vehicle roof in such a manner that with the mount secured about a roof aperture the mast depends vertically through said fitting with a lower end thereof accessible from within the vehicle; a bracket slidably located about said mast between an upper end of said mast and said mount, and an antenna dish pivoted to said bracket about a first axis extending in a plane substantially at right angles to the longitudinal axis of said mast and pivoted to linkage means about a second axis parallel to and spaced from said first axis, said linkage means in turn being pivoted to said mast in the region of the upper end thereof about a third axis parallel to and spaced from the first two axes in order to form a triangulated linkage such that, in use, with said mast extended relatively to said bracket the antenna dish adopts a generally upright signal reception position whereas retraction of the mast relatively to said bracket is effective to fold the antenna dish into a generally horizontal position for storage.

Preferably, the mount includes means for adjusting the spacing between first and third axes with the mast in an extended position, to enable adjustment of the elevation of the antenna dish when in the signal reception position. Conveniently, said means may be provided by a cam arranged to engage with said linkage proximate said third axis such that rotation of said cam displaces said linkage about said third axis thereby adjusting the elevation of the antenna dish. The mount may be provided with biasing means to urge separation between said first and third axes. Again preferably, a boom for supporting a feed horn is hingedly connected to said bracket to facilitate unobstructed folding of said mount.

In order to aid in understanding the invention embodiments thereof will now be described by way of example and with reference to the accompanying drawings, in which.

Figure 1:
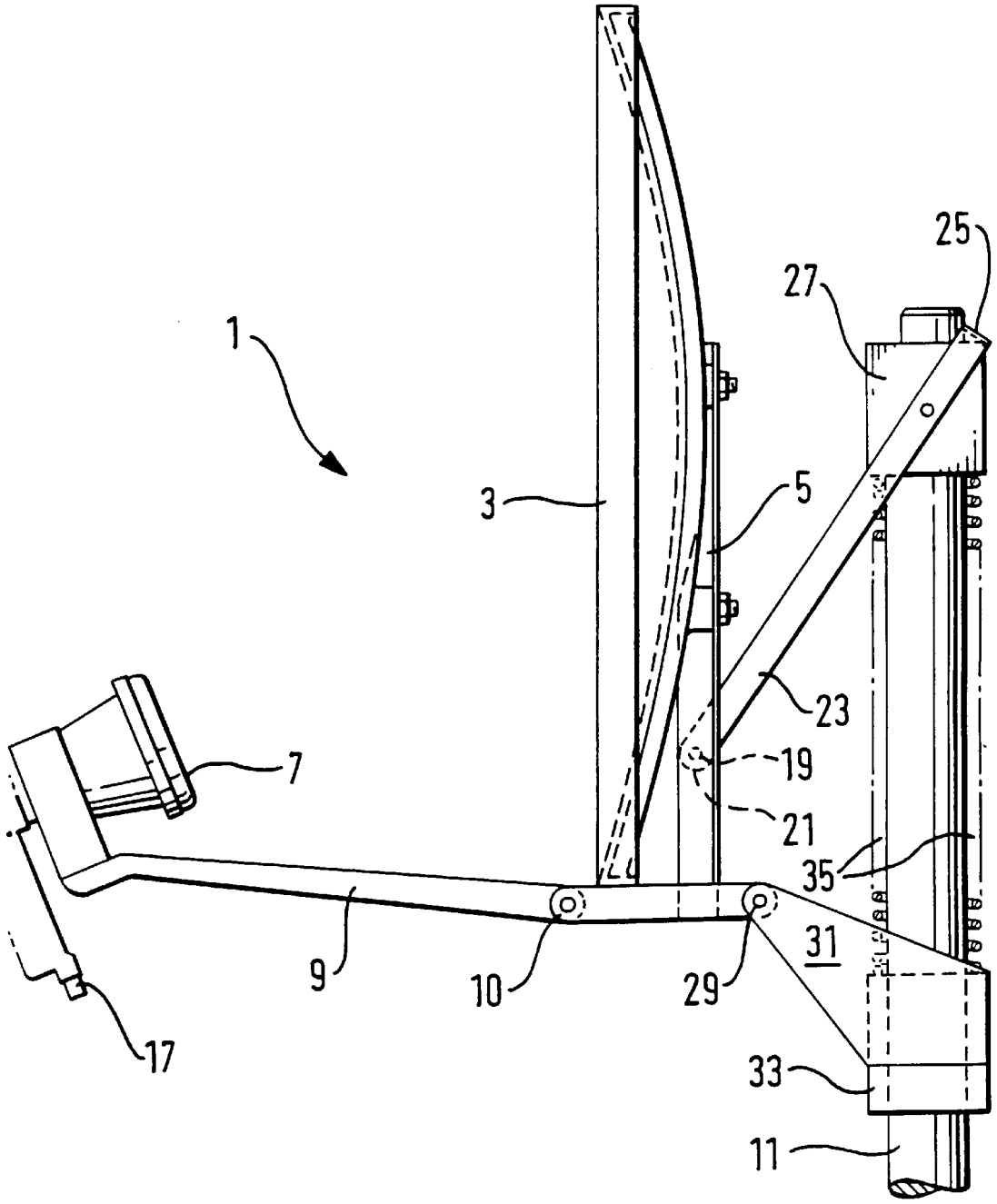
FIG. 1 is a side view of an antenna mount according to the invention shown in a raised position.
Figure 2:
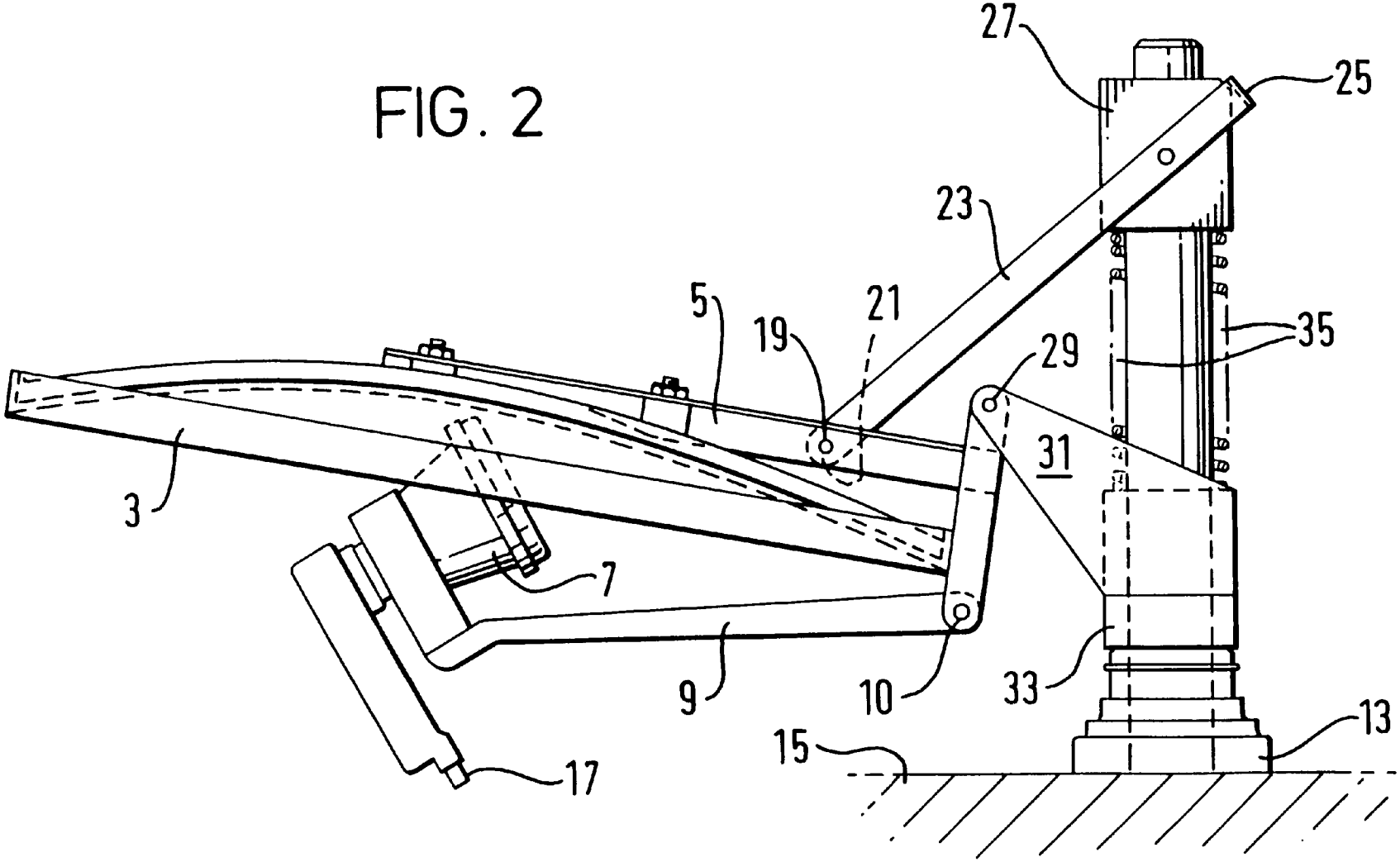
FIG. 2 is a similar view of the mount of FIG. 1 shown in a lowered position.
Figure 3:
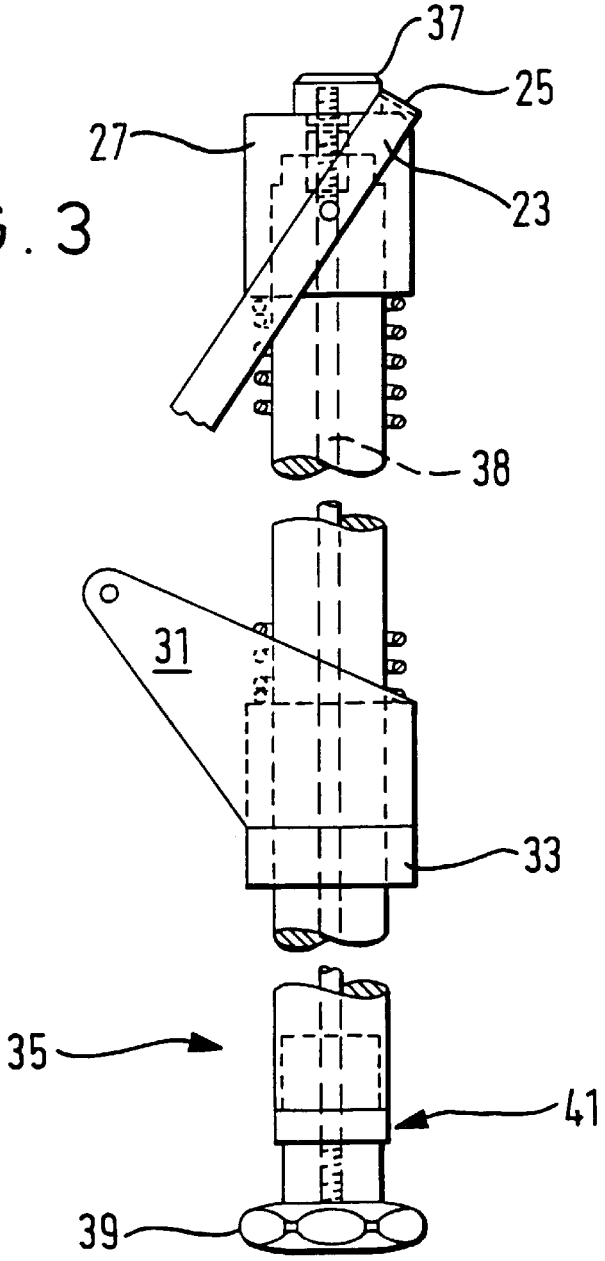
FIG. 3 is a similar scrap part-sectioned view of the mount of FIG. 1 showing its elevation adjustment mechanism.
Figure 4:
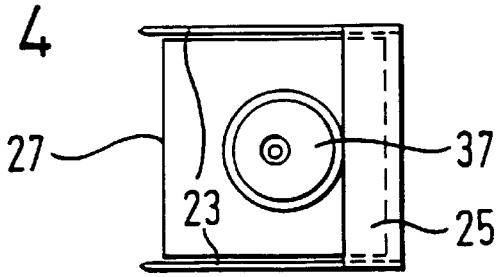
FIG. 4 is a scrap plan view of the mast and said elevation adjustment mechanism.

The antenna mount 1 shown in FIGS. 1 to 3, carries a conventional satellite reception antenna 3 attached to a bracket 5 and associated feedhorn 7 attached to a boom 9 projecting via a spring-loaded connection 10 from said bracket 5. The mount 1 is supported by a retractable mast 11 secured via a through fitting 13, to the roof 15 of a vehicle (not shown). signals received by the antenna 3 are focused at the feedhorn 7 and fed via right-angle connector 17 to suitable cabling (not shown) which extends along the boom 9 and bracket 5, and passes via an aperture (not shown) into the mast 11, and thence to a receiver (not shown) within the vehicle.

To facilitate folding of the mount 1 through a scissor like action, the bracket 5 has an upper pin joint 19 connected to one end 21 of a rotatable support arm 23 whose other end 25 is pinned to a masthead block 27, and a lower pin joint 29 secured to a fixed support arm 31 which is connected to a block 33 which is free to slide on said mast. A tension spring 35 housed on the mast 11 and captured between the blocks 27, 33 urges them into a spaced apart configuration as shown in FIG. 1.

In addition to being retractable through the fitting 13, the mast 11 provides both azimuth and elevation adjustment of the antenna 3 attached to the bracket 5.

A portion 35 of the mast 11 which extends into the vehicle via the fitting 13 may be rotated bodily to provide azimuth adjustment.

Elevation adjustment is provided by a cam 37 positioned on the masthead block 37 against which the end of the rotatable support arm 23 abuts. A shaft 38 keyed to the cam 37 passes axially through the mast 11 and terminates in a knurled knob 39 at the extreme end 41 of the portion 35 within the vehicle. Rotation of the knob 39 brings about a corresponding rotation of the cam 37 and angular displacement of the arm 23.

Figure 8:
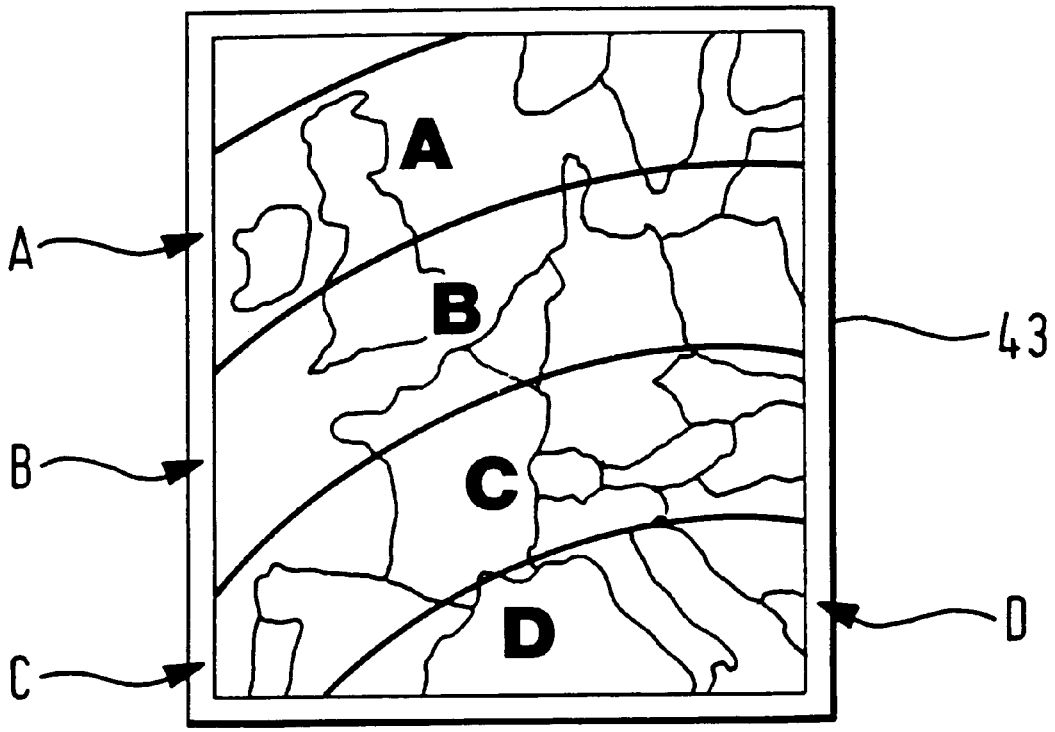
FIG. 8 is a map showing regions having different elevation requirements for use with the mounts of FIG. 1 and FIG. 5.
Figure 9:
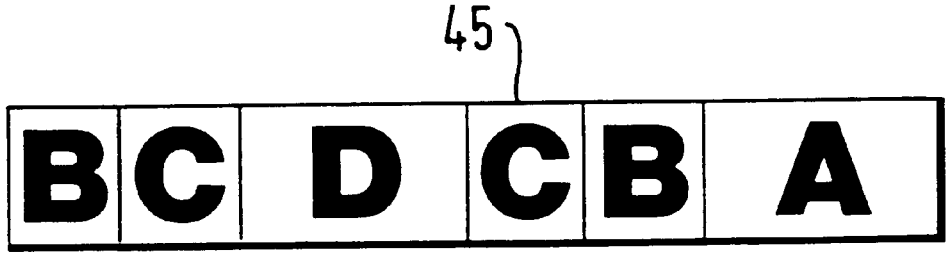
FIG. 9 is a label showing corresponding elevation indicia for use with the elevation adjustment means of the mount of FIG. 1.

Referring to FIGS. 8 and 9, in order to facilitate simple adjustment of elevation of the antenna 3 for latitude, a map 43 is separately provided on which are indicated bands of latitude A, B, C, D. A label 45 bearing corresponding indicia is positioned on the mast 11 proximate the knob 39. A pointer (not shown) is engraved or otherwise marked on the knob 39 so that rotation of the knob 39 brings the pointer into line with the desired indicium for the latitude of the vehicle.

When required, the mount 1 can be folded by retracting the mast 11 through the fitting 13 into the vehicle. The slider block 33 is thus brought into abutment with the fitting 13 so that continued retraction of the mast 11 compresses the spring 35 and operates the scissor action of the mount 1 causing the antenna 3 to lay approximately parallel to the roof 15. Torsion provided by the spring-loaded connection 10, in addition to its own weight, ensure that the boom 9 adopts a position between the antenna 3 and roof 15. A locking mechanism (not shown) such as lock ring is provided to retain the mast 11 in the folded position.

Erection of the mount 1 is carried out by releasing the mast locking mechanism and extending the mast 11. The spring 35 ensures that the upper and lower blocks 27, 33 adopt a spaced apart position with the antenna 3 aligned broadly perpendicular to the roof 15. The spring-loaded connection 10 ensures that the boom 9 extends to place the feedhorn 7 at the focus of the antenna 3.

Figure 5:
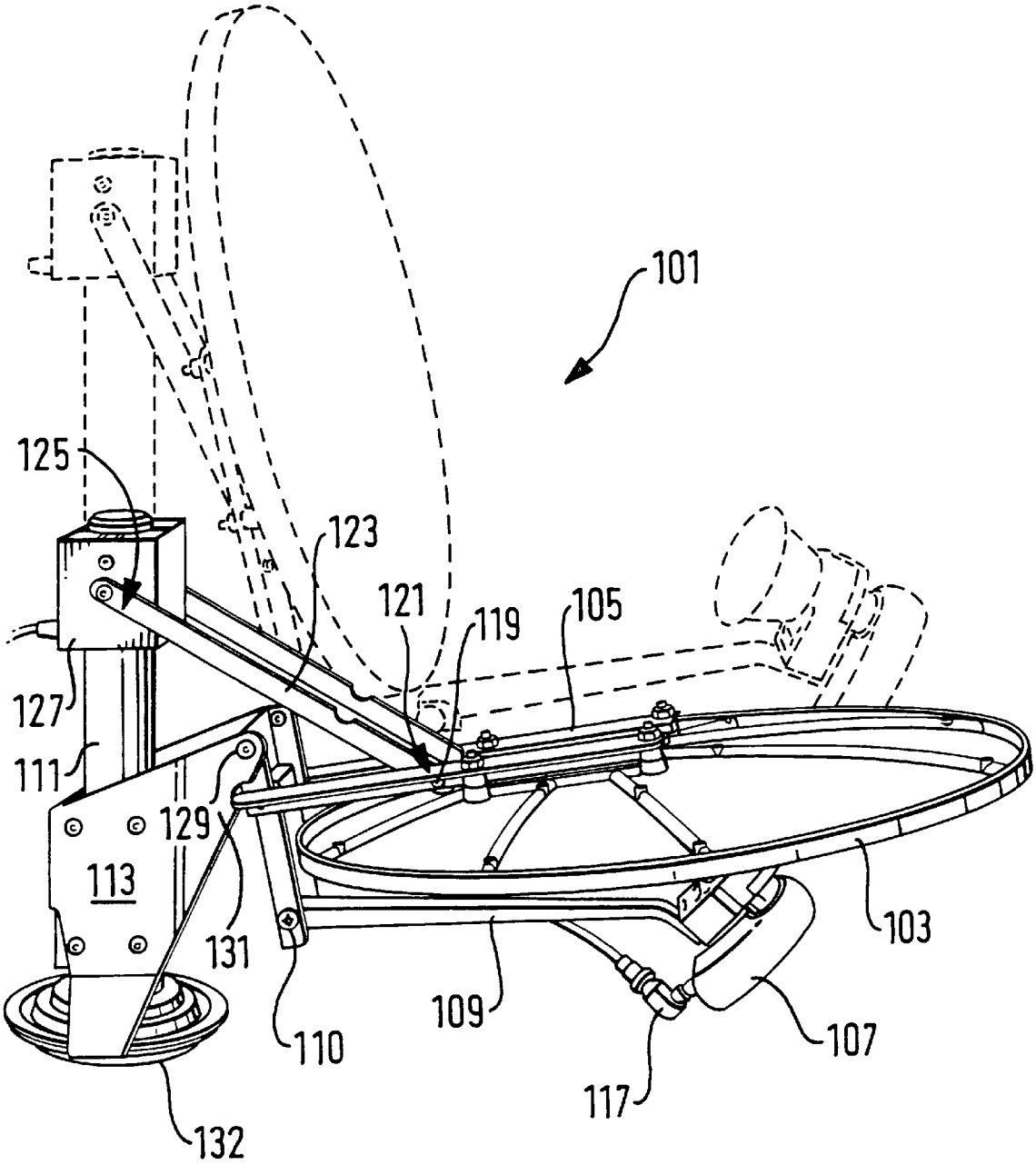
FIG. 5 is a perspective view of an antenna mount according to a further embodiment of the invention shown in both a lowered and a raised position.
Figure 6:
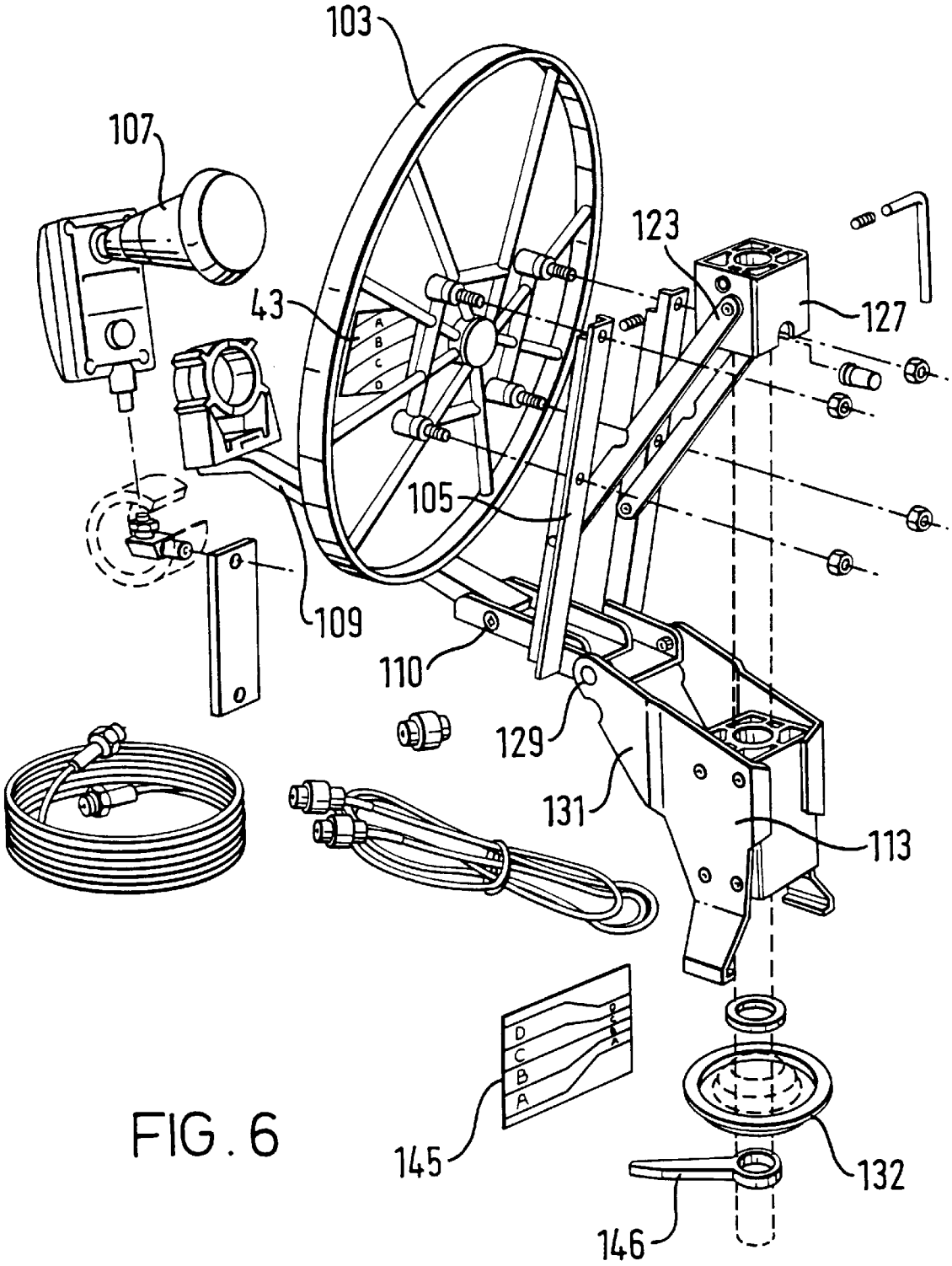
FIG. 6 is a reversed perspective exploded view of the mount of FIG. 5 shown in a raised position.
Figure 7:
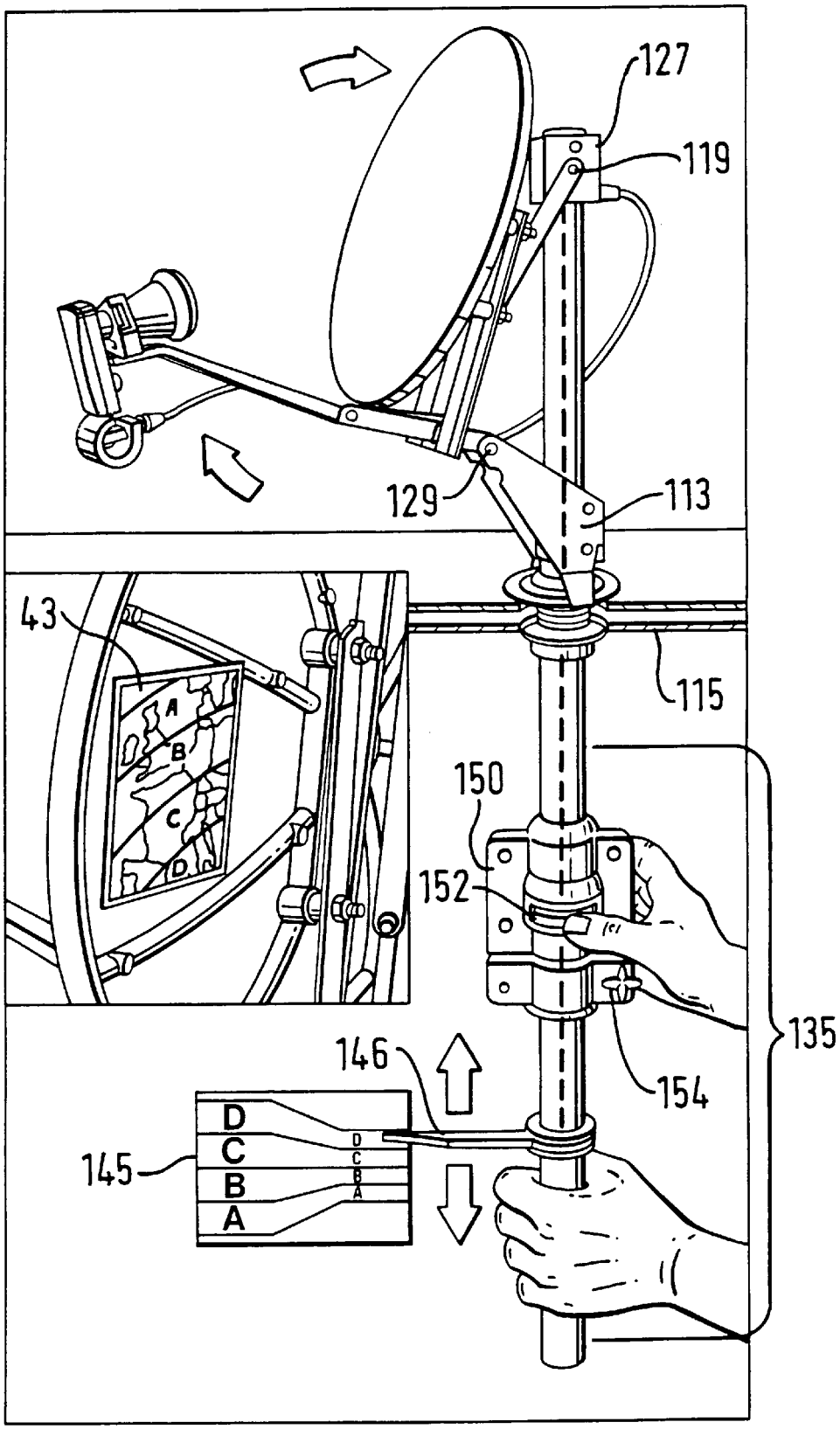
FIG. 7 is diagrammatic view of the mount of FIG. 5 shown installed in a vehicle.

Turning now to the further embodiment shown in FIGS. 5 to 7, the antenna mount 101 shown in the Figures, carries a conventional satellite reception antenna 103 attached to a bracket 105 and associated feedhorn 107 attached to a boom 109 projecting via a spring-loaded connection 110 from said bracket 105. The mount 101 is supported by a retractable mast 111 secured via a through fitting 113, to the roof 115 of a vehicle (not shown). Signals received by the antenna 103 are focused at the feedhorn 107 and fed via right-angle connector 107 to suitable cabling (not shown) which extends along the boom 109 and bracket 105, and passes via an aperture (not shown) into the mast 111, and thence to a receiver (not shown) within the vehicle.

To facilitate folding of the mount 101 through a scissor like action, the bracket 105 has an upper pin joint 119 connected to one end 121 of a rotatable support arm 123 whose other end 125 is pinned to a masthead block 127, and a lower pin joint 129 secured to a fixed support arm 131 of said fitting 113, which is rotatably secured to a plate 132 which is fixed to the roof 115 of the vehicle, the mast being free to slide through the fitting 113 and to rotate with the fitting 113 on the fixed plate 132. In use, the masthead block 127 and the fitting 113 are brought into a spaced apart configuration as shown in FIG. 5 (in ghost), by raising the mast 111.

In addition to being retractable through the fitting 113, the mast 111 provides both azimuth and elevation adjustment of the antenna 103 attached to the bracket 105.

A portion 135 of the mast 111 which extends into the vehicle via the fitting 113 may be rotated bodily to provide azimuth adjustment.

Elevation adjustment is provided by a clamp arrangement 150 located within the vehicle. The clamp arrangement 150 has a spring loaded push-button 152 which must be depressed to allow the mast 111 to descend into the vehicle, but which otherwise allows the mast 111 to be raised, and as a further safety feature includes a separate screw clamp 154 which, when tightened, prevents any vertical or rotational movement of the mast 111.

Consequently, the mast 111 may be raised or lowered as necessary to bring about a corresponding change in the relative displacement of the masthead block 127 and the fitting 113. To facilitate simple and accurate adjustment and referring once more to FIG. 8, the map 43 is separately provided on which are indicated bands of latitude A, B, C, D. A label 145 bearing corresponding indicia is positioned near a pointer 146 fixed to the portion 135 of the mast 111 within the vehicle. The pointer 146, which is free to rotate but not slide on the mast 111, is positioned so that by raising or lowering the mast 111 the pointer 146 is brought into line with the desired indicium for the latitude of the vehicle.

When required, the mount 101 can be folded by retracting the mast 111 through the fitting 113 into the vehicle. The upper block 127 is thus brought into abutment with the fitting 113, whereby the scissor action of the mount 101 causes the antenna 103 to lay approximately parallel to the roof 115. Torsion provided by the spring-loaded connection 101, in addition to its own weight, ensure that the boom 109 adopts a position between the antenna 103 and roof 115. The clamping arrangement 136 is then utilised to lock the mast 111 in the folded position.

Erection of the mount 101 is carried out by releasing the screw clamp 154 of the clamp arrangement 150 and extending the mast 111 so that the block 127 and fitting 113 adopt a spaced apart position with the antenna 103 aligned broadly perpendicular to the roof 115. The spring-loaded connection 110 ensures that the boom 109 extends to place the feedhorn 107 at the focus of the antenna 103.

I claim:

1. A collapsible dish antenna for a vehicle roof comprising a mast slidably and rotatably received in a mount for attachment to the vehicle roof in such a manner that with the mount secured about a roof aperture the mast extends vertically through a fitting with a lower end thereof accessible from within the vehicle; a bracket slidably located about said mast between an upper end of said mast and said mount, and an antenna dish pivoted to said bracket about a first axis extending in a plane substantially at right angles to the longitudinal axis of said mast and pivoted to linkage means about a second axis parallel to and spaced from said first axis, said linkage means in turn being pivoted to said mast in the region of the upper end thereof about a third axis parallel to and spaced from the first two axes in order to form a triangulated linkage such that, in use, with said mast extended relatively to said bracket the antenna dish adopts a generally upright signal reception position whereas retraction of the mast relatively to said bracket is effective to fold the antenna dish into a generally horizontal position for storage.

2. An antenna mount as claimed in claim 1, including means for adjusting the spacing between first and third axes with the mast in an extended position, to enable adjustment of the elevation of the antenna dish when in the signal reception position.

3. An antenna mount as claimed in claim 1, wherein the mount is provided with biasing means to urge separation of said first and third linkage axes.

4. An antenna mount as claimed in claim 2, wherein the means for adjusting the elevation of said dish antenna is conveniently provided by a cam arranged to engage with said linkage proximate said third axis such that rotation of said cam displaces said linkage thereby adjusting the elevation of said antenna dish.

5. An antenna mount as claimed in claim 1, wherein a boom for supporting a feedhorn, is hingedly connected to said bracket to facilitate unobstructed folding of said mount.

6. An antenna mount as claimed in claim 1, wherein said mast is rotatable about a substantially vertical axis to provide azimuth adjustment.

7. An antenna mount as claimed in claim 1, wherein the mast is provided with indicator means to facilitate adjustment of the antenna elevation for latitude.

8. An antenna mount as claimed in claim 7, in which the indicator means includes a pointer rotatably attached to said mast.

* * * * *